United States Patent [19]

Rosinbaum et al.

[11] 4,136,762

[45] Jan. 30, 1979

[54] LOG DISPENSER FOR FIREPLACE

[76] Inventors: Jacky R. Rosinbaum, Rte. 1, Clyde, Tex. 79510; Terry L. Rosinbaum, 2612 Smith Barry, Arlington, Tex. 76010

[21] Appl. No.: 815,535

[22] Filed: Jul. 14, 1977

[51] Int. Cl.[2] ..... B65G 11/20

[52] U.S. Cl. ..... 193/34; 222/505

[58] Field of Search ..... 193/2 R, 5, 33, 34, 193/35 A, 40; 221/289, 296, 298, 301; 222/425, 445, 505, 510, 561, 547; 214/1 PB; 110/108, 116

[56] References Cited

U.S. PATENT DOCUMENTS

| | | | |
|---|---|---|---|
| 333,546 | 1/1886 | Prentiss et al. | 222/505 |
| 724,346 | 3/1903 | Smith | 222/505 |
| 779,128 | 1/1905 | Mummey et al. | 222/561 X |
| 1,001,691 | 8/1911 | Rosen | 193/2 R X |
| 1,554,071 | 9/1925 | Downs | 222/457 X |
| 1,762,530 | 6/1930 | Sandell | 222/457 X |
| 2,479,347 | 8/1949 | Gotham | 222/505 |
| 2,582,207 | 1/1952 | Shaw | 222/457 X |
| 3,083,057 | 3/1963 | Kiser et al. | 222/505 X |
| 3,348,733 | 10/1967 | Johnson | 221/298 |

*Primary Examiner*—Robert W. Saifer
*Assistant Examiner*—James L. Rowland
*Attorney, Agent, or Firm*—Peter J. Murphy

[57] ABSTRACT

In a building structure with a partition having an opening, a log dispenser includes coacting interior and exterior log boxes having a common inclined floor which forms the base of the opening. The interior box includes a vertical wall or log stop at the inner extremity of the inclined floor spaced from the partition. The exterior box includes enclosing end walls and a side wall, and a suitable closure cover. The exterior box also includes horizontal shelf means providing an inclined surface above the partition opening for guiding logs away from the partition towards the side wall and onto the inclined floor. A vertically sliding closure door is guided for movement at the exterior side of the partition. Door operator means include a bell crank mounted within the partition opening including a journal shaft, a lifting arm adjacent to the door, and a handle arm disposed at the inner face of the partition. The lifting arm is pivotally connected to the door by means of a suitable link. The handle arm is a stub handle configured to receive a removable handle extension.

8 Claims, 6 Drawing Figures

LOG DISPENSER FOR FIREPLACE

BACKGROUND AND SUMMARY OF THE INVENTION

This invention relates to a log storage and dispensing means for a fireplace, which is incorporated in a building structure.

The invention is concerned with means for providing, conveniently, an adequate supply of firewood for a building such as a home or cabin having a fireplace, so as to enable use of the fireplace for a substantial time without the necessity for leaving the building.

One object of this invention is to provide for convenient storage of firewood for a fireplace, which storage is at the exterior of the main building enclosure, but is still easily accessible from within the enclosure.

Another object of this invention is to provide log storage and dispensing means which will enable transfer of firewood from the exterior to the interior of a building enclosure, with minimum heat loss through a building opening or portal.

A further object of this invention is to provide such a log storage and dispensing means which is readily operated by the user, and which is designed to prevent unintended operation by small children.

These objects are accomplished in a log dispenser for use in combination with a building partition. The log dispenser comprises a partition having an opening, an exterior log box disposed at the exterior side of the partition opening, and an interior log box disposed at the interior side of the partition opening, with the exterior and interior boxes having a common inclined floor defining the bottom of the opening. A closure door is mounted at the exterior side of the partition to close the opening and is mounted for vertical movement in guide means at the side edges of the opening. The door operator mechanism includes a bell crank and a coupling link. The bell crank comprises a journal shaft, a lift arm disposed for swinging movement in a plane adjacent to the plane of the door, and a handle arm disposed for swinging movement in a plane adjacent to the interior side of the partition. Pivot means connect the coupling link to the door and to the lift arm; and bushing means mounted in the partition opening rotatably support the bell crank journal shaft.

The novel features and the advantages of the invention, as well as additional objects thereof, will be understood more fully from the following description when read in connection with the accompanying drawings.

DRAWINGS

DESCRIPTION OF THE PREFERRED EMBODIMENT

Figure 1:
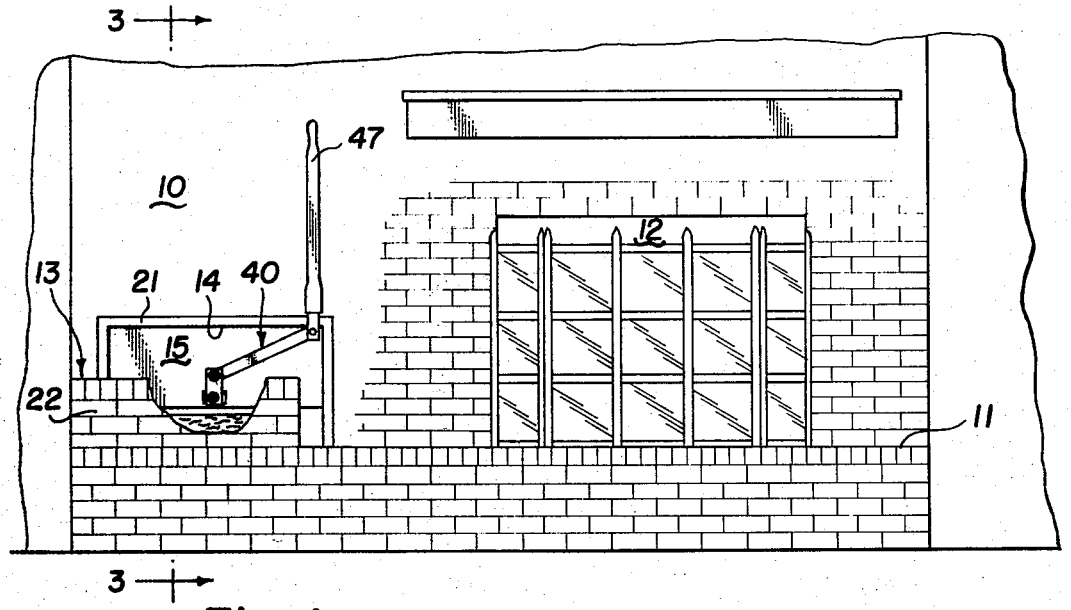
FIG. 1 is a front elevation view, from the interior of a building structure, of a hearth, fireplace and interior portion of a log dispenser according to the invention.
Figure 2:
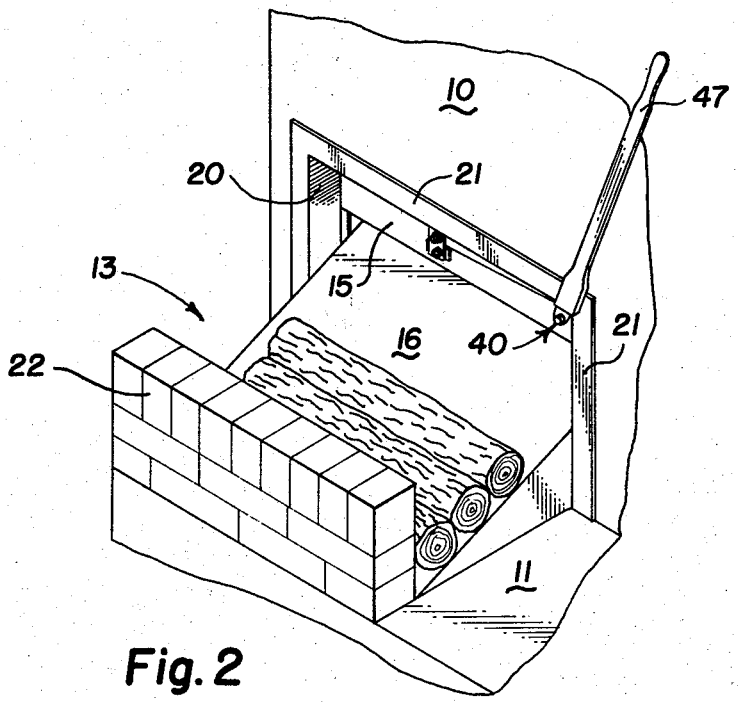
FIG. 2 is a perspective view of the log dispenser of FIG. 1 with the door partially open.

FIGS. 1 and 2 of the drawing are views from the interior of a building structure illustrating the interior log box and adjacent fireplace. Referring particularly to FIG. 1 the illustrated building structure includes an exterior building partition 10, an elongated hearth structure 11, a fireplace 12 and the interior log box 13 adjacent to the fireplace and located on the hearth. The interior box 13 communicates with an opening 14 in the partition 10, which is closed by a sliding door 15, and with the exterior log box 16. Also shown is the door opening and closing mechanism which will be described subsequently.

An inclined floor 17 is common to the exterior box and interior box and defines the bottom of the wall opening 14. This floor is inclined downwardly from the outer box toward the inner box and defines all or substantially all of the floor surfaces for both boxes. The side walls and top wall of the opening 14 are preferably faced with metal facing plates 20 to protect these surfaces; and additional metal framing strips 21 are provided against the partition surface around the opening, forming a decorative and protective framing for the opening. These framing strips may be welded to the facing plates, for example.

As seen in the figures, the interior box 13 is defined by an inclined floor 17 which extends inwardly from the partition 10 terminating at a vertical sidewall or log stop 22 which extends upwardly from the hearth 11 parallel with the partition 10.

Figure 3:
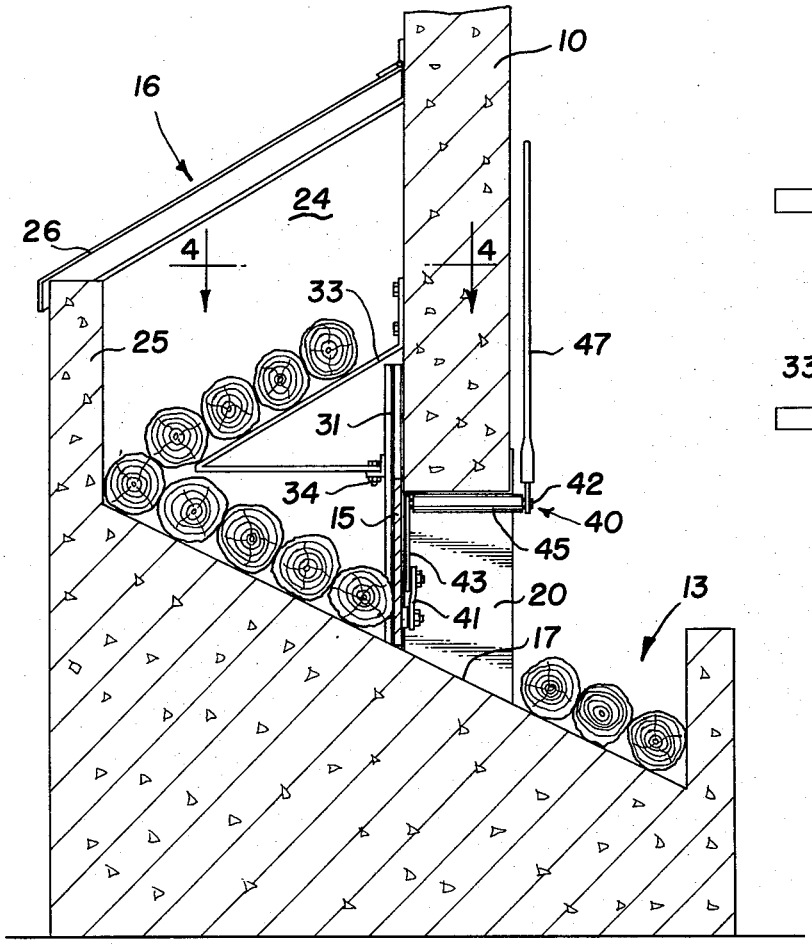
FIG. 3 is a sectional view of the log dispenser taken in the plane 3—3 of FIG. 1.

FIG. 3 is a transverse sectional view through the partition 10, the interior box 13, and an exterior box 16, illustrating that the inclined floor 17 is common to the exterior box, the interior box and the partition opening. The partition 10, which is referred to as an exterior partition, may be the exterior structural wall of a house or cabin separating the heated interior of the structure from the unheated exterior. It should be understood that the exterior of this partition, and therefore the exterior box 16, may be contained in an attached unheated structure such as a garage, shed or other outbuilding.

The exterior box includes a built up base to define its portion of the inclined floor 17, end walls 24 and side wall 25 which together with the partition 10 define the enclosure for logs or firewood, with the box being closed by a hinged closure cover 26. Preferably the cover is designed to seal the box from the elements and to shed precipitation.

The door 15 may be a steel door, fabricated from a 3/16 inch metal plate for example, which is guided for vertical movement at the exterior side of the partition 10 by suitable guide channels 31 mounted at the sides of the opening 14.

Figure 4:
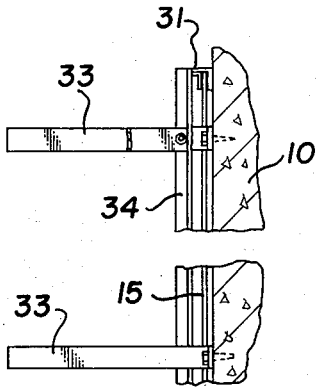
FIG. 4 is a top view of the exterior log box, viewed from the plane 4—4 of FIG. 3.
Figure 6:
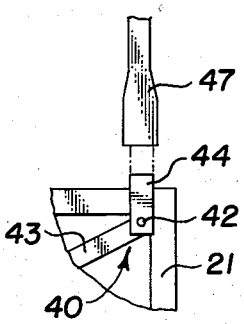
FIG. 6 is a fragmentary view of the door operating mechanism showing an extension handle separated from a stub handle.
Figure 5:
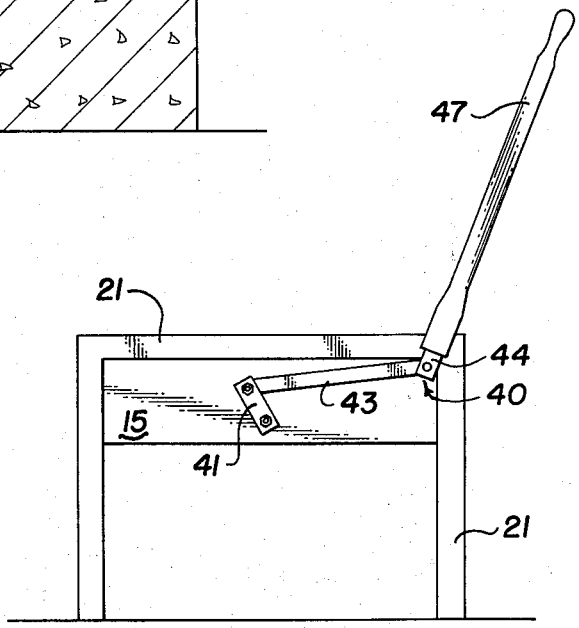
FIG. 5 is a diagrammatic view of the partition opening, door and door operating mechanism, with the door in the open condition.

As particularly seen in FIGS. 3 and 4, the exterior box includes structure defining a shelf or baffle disposed above the opening 14, and providing an outwardly inclined surface to direct logs away from the partition 10 towards the side wall 25. As illustrated, the particular structure for this purpose includes a pair of brackets 33 formed from strap metal for example with the upper portions of the brackets being secured as by bolting to the partition 10 and the lower portions of the brackets being anchored to a transverse anchor bar, in the form of an angle 34, which is in turn secured to and bridges the door guide channels 31. With this structure, round logs of suitable diameter will be guided in a single row from the top of the box adjacent to the partition 10, outwardly toward the side wall 25, and then inwardly on the inclined floor 17 toward the door 15. This movement of a single row of logs will be effected by gravity. Preferably, the brackets 33 and associated support structure are readily removable in the event that this particular feed feature is not desired by the user.

As seen in the drawings, the mechanism for raising and lowering the door 15 includes a bell crank 40 and associated link 41 mounted within the opening 14, and operable from the interior side of the partition 10. The bell crank 40 consists of a journal shaft 42, a transverse lift arm 43 disposed for swinging movement in a plane immediately adjacent to the interior face of the door 15, and a handle arm 44 disposed for swinging movement in a plane immediately adjacent to the inner side of the partition 10. The bell crank assembly 40 includes a suitable bushing member 45, such as a section of iron pipe for example, enclosing the journal shaft and adapted to be suitably mounted by welding, for example, to metal facing plates 20 for the opening 14. Desirably, this bushing pipe may include some form of fitting for applying grease to the bushing and journal. The link 41 is pivotally connected to both the lift arms 43 and the door 15 to allow swinging movement of the lift arm between the door closed position illustrated in FIG. 1 and the door open condition illustrated in FIG. 2.

To prevent the opening or lifting of the door 15 by younger children, and also perhaps for aesthetic reasons, the handle arm 44 may be in the form of a relatively short stub handle adapted to receive a much longer handle extension 47 to provide the desired leverage for opening and closing the door. While the lifting of the door will not normally present a problem, the lowering of the door might be interfered with by a log positioned within the opening; and it may be necessary to use a fireplace tool to push the logs away from the door while exerting some force to lower it to the closed position.

With the exterior box 16 being sealed by a suitable closure cover 26, the loss of heated air from the building enclosure through the opening 14 will be minimized when the door 15 is opened.

What has been described is a unique dispenser for logs or firewood for a fireplace, which includes log storage boxes at both the interior and exterior of a building structure, with convenient means for transferring the logs from the exterior storage box to the interior storage box.

A particular feature of the invention is that the design includes means for gravity feed or movement of logs from the exterior storage box to the interior storage box, controlled by a vertically movable door between the boxes, and an easily operable mechanism for opening and closing the door.

Another feature of the invention is that the door operator mechanism includes a removable extension handle at the interior or operator side to enable adequate leverage for raising and lowering the door by the user, and which is removable to prevent operation by small children, for example. Also, since the long handle may not be aesthetically pleasing, the mechanism may be designed with the shorter handle arm presenting a more pleasing appearance.

A particular feature of the invention is that the exterior box may be provided with an inclined shelf designed for directing a single row of round logs in a manner to facilitate gravity feed of the single row from the top of the box toward the door.

A particular added advantage of the invention is that the interior and exterior boxes may be loaded during the day, so that an adequate supply of firewood or logs is available for use for an extended period such as late afternoon and during the evening to maintain a fire in the fireplace without the necessity for leaving the building enclosure. An ancillary advantage is that when it is necessary to open the dispenser door to allow the flow of additional logs from the exterior box to the interior box, there is minimum heat loss from the enclosure for the reason that the opening is relatively small and also for the reason that the exterior box is preferably sealed by a suitable closure cover.

While the preferred embodiment of the invention has been illustrated and described, it will be understood by those skilled in the art that changes and modifications may be resorted to without departing from the spirit and scope of the invention.

What is claimed is:

1. A log dispenser for use in combination with a generally vertical building partition comprising a partition having an opening; an exterior box disposed at the exterior side of said partition opening; and an interior box disposed at the interior side of said partition opening; said exterior and interior boxes having a common inclined floor defining the bottom of said opening;

a closure door mounted for generally vertical sliding movement at the exterior side of said partition to close said opening; guide means mounted at the side edges of said opening, for guiding the sliding movement of said door;

door operator means comprising a bell crank and a coupling link; said bell crank comprising a journal shaft, a lift arm disposed for swinging movement in a plane adjacent to the plane of said door, and a handle arm disposed for swinging movement in a plane adjacent to the interior side of said partition; means pivotally connecting said coupling link to said door and to said lift arm; and bushing means mounted in said partition for rotatably supporting said journal shaft.

2. A log dispenser as set forth in claim 1 said handle arm comprising a short stub handle, and an elongated extension handle having means for ready engagement with said stub handle.

3. A log dispenser as set forth in claim 1 said interior box comprising the interior portion of said inclined floor, and a vertical side wall disposed adjacent the inner extremity of said inclined floor in spaced relation to said partition.

4. A log dispenser as set forth in claim 1 said exterior box comprising the exterior portion of said inclined floor, a pair of spaced end walls transverse to said partition, a vertical side wall disposed in spaced relation to said partition and connecting said end walls; and a hinged cover enclosing said box.

5. A log dispenser as set forth in claim 4 said exterior box further comprising means defining a shelf mounted on the exterior face of said partition above said opening, providing an inclined guide surface for directing logs away from said partition toward said side wall.

6. A log dispenser as set forth in claim 4 said exterior box further comprising a hinged closure cover.

7. A log dispenser as set forth in claim 1 said exterior box comprising: the exterior portion of said inclined floor; a generally vertical wall disposed in generally parallel spaced relation with said partition; and means defining a shelf mounted on said partition above said opening, providing a guide surface inclined outward and away from said partition; and said shelf coacting with said wall and said floor to pass a single row of logs to said inclined floor.

8. A log dispenser as set forth in claim 1 said building partition having substantial thickness; and said journal shaft having a length corresponding to the thickness of said partition.

* * * * *